US005899465A

United States Patent [19]

Mayer, II

[11] Patent Number: 5,899,465

[45] Date of Patent: May 4, 1999

[54] ROLLER SKATE WITH BRAKE

[76] Inventor: Bruce A. Mayer, II, P.O. Box 145, Mendham, N.J. 07945

[21] Appl. No.: 08/657,967

[22] Filed: Jun. 4, 1996

Related U.S. Application Data

[63] Continuation-in-part of application No. 08/472,382, Jun. 7, 1995, Pat. No. 5,685,550.

[51] Int. Cl.[6] ..... A63C 17/00

[52] U.S. Cl. ..... 280/11.2; 280/11.22; 280/11.28; 280/843

[58] Field of Search ..... 280/843, 87.041, 280/87.042, 11.19, 11.2, 11.22, 11.23, 11.24, 11.26, 11.27, 11.28

[56] References Cited

U.S. PATENT DOCUMENTS

| | | | |
|---|---|---|---|
| 597,025 | 1/1898 | Schwartz | 280/843 |
| 4,153,263 | 5/1979 | Yoshimoto | 280/843 |
| 4,618,158 | 10/1986 | Liberkowski | 280/843 |
| 5,366,232 | 11/1994 | Pozzobon et al. | 280/11.22 |
| 5,375,859 | 12/1994 | Peck et al. | 280/11.22 |
| 5,486,011 | 1/1996 | Nelson | 280/11.28 |
| 5,536,025 | 7/1996 | Landay | 280/11.22 |
| 5,549,331 | 8/1996 | Yun et al. | 280/843 |

*Primary Examiner*—Brian L. Johnson
*Assistant Examiner*—Frank Vanaman
*Attorney, Agent, or Firm*—Barry Evans; Leonard J. Santisi

[57] ABSTRACT

A roller skate of the in-line wheel type where all wheels are mounted for rotation in the normal skating directions has at least one wheel mounted for rotation about an axis perpendicular to the skating directions. An internal brake is provided to progressively retard the rotation about the axis perpendicular to the skating directions to provide a braking mechanism so the skater can stop by executing what is known as a hockey stop.

19 Claims, 4 Drawing Sheets

FIG. 1
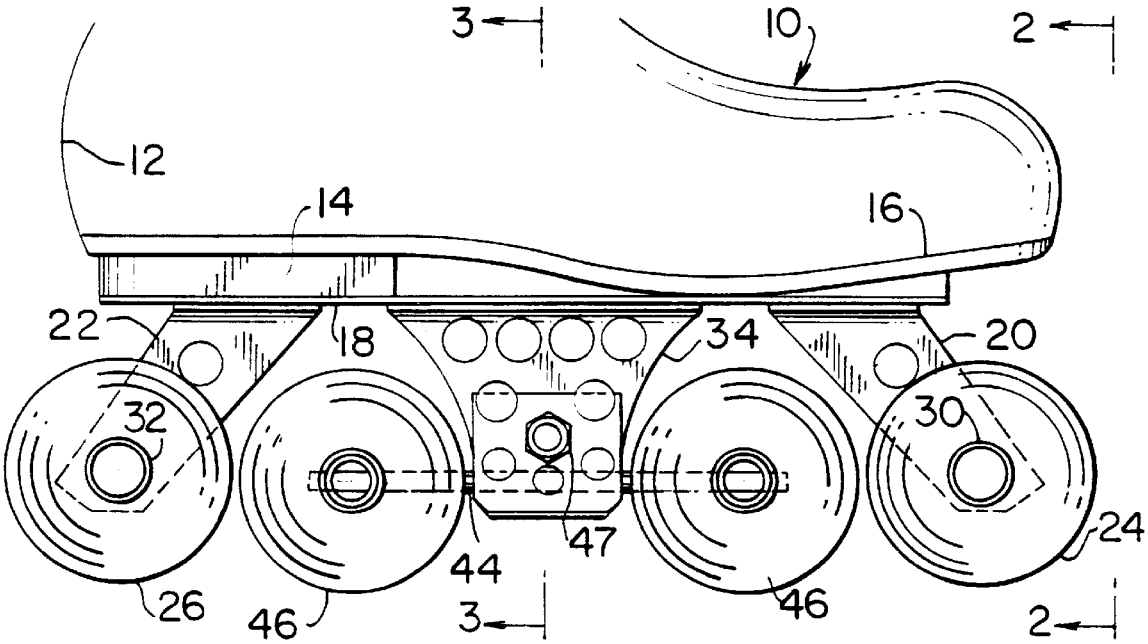
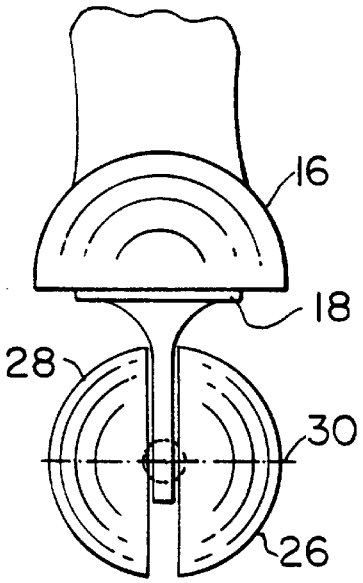
FIG. 2
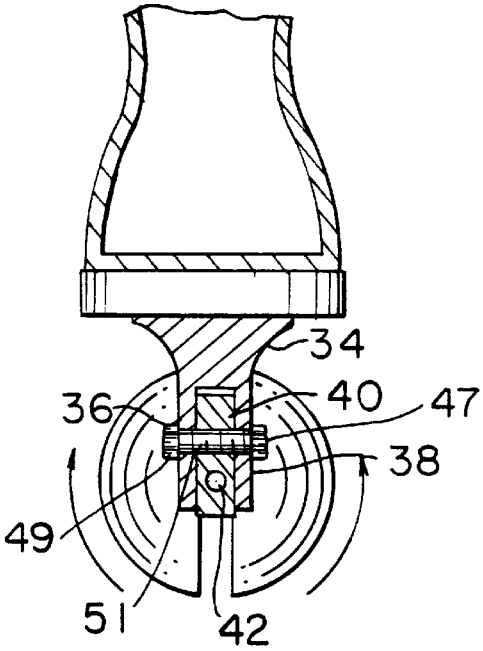
FIG. 3

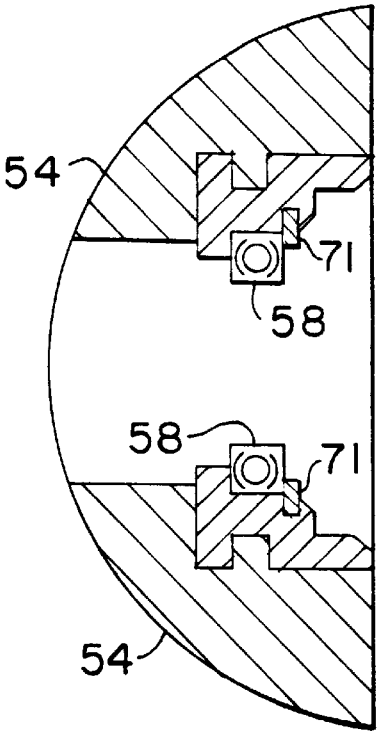
FIG. 8
FIG. 9
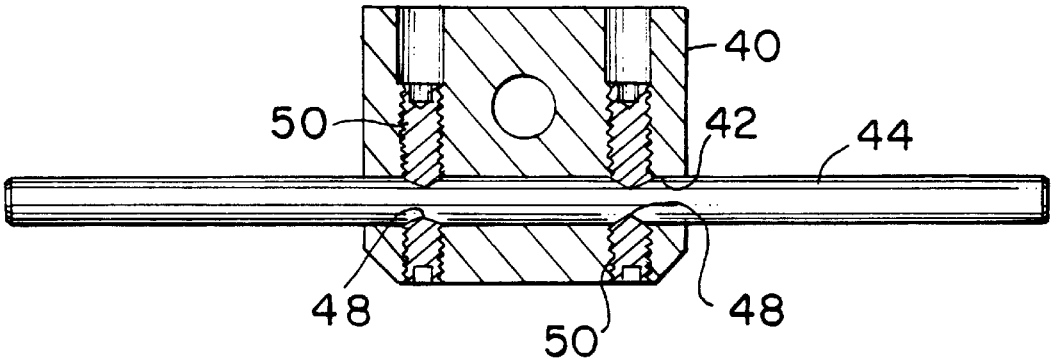

ROLLER SKATE WITH BRAKE

This application is a continuation-in-part of U.S. application Ser. No. 08/472,382 filed Jun. 7, 1995, now U.S. Pat. No. 5,685,550 the disclosure of which is hereby incorporated by reference.

This invention relates to roller skates, particularly of the in-line type, where a plurality of wheels are aligned in a linear array. More particularly the present invention is directed to in-line roller skates provided with transverse acting braking arrangements.

FIELD OF THE INVENTION

Roller skates, particularly of the in-line type which have a single linear array of wheels, are presently very popular and in wide use. In fact one area of increasing popularity for in-line roller skates is in the use of such skates to play "roller" hockey. These skates tend to replicate the type of skating experienced with ice skates. One problem with in-line roller skates, as with all roller skates, is providing an effective provision for stopping. One widely used stopping device for roller skates is a rubber bumper extending downwardly at the front or rear of the skate. To stop forward skating motion the skater tilts the toe or heel down to cause the bumper to contact the pavement to provide friction and resistance to the forward motion of the skater.

However, in ice skating, a popular way of stopping forward motion is known as the hockey stop. In a manner similar to the use of skis, the skater makes a sharp turn to the side and the blade of the ice skate is turned transversely to the forward direction of the skater. The skate blade, now positioned transverse to the previous direction of movement, slides along and digs into the ice to provide a quick stopping action.

Another difference between in-line roller skates and an ice skate is that present in-line skates provide multiple wheels all positioned at the same level so that the full array of wheels are in contact with the skating surface. Also, typically, inline roller skates are provided with wheels which are substantially short cylindrically shaped wheels or barrel shaped to provide a relatively wider surface area of contact with the skating surface. These two factors tend to limit the ability of the skater to make sharp turns as can be executed with ice skates.

Because conventional in-line roller skates have somewhat limited turning capabilities stopping is usually accomplished by depressing the toe or heel to place the rubber bumper in contact with the ground to arrest forward momentum. If a skater is traveling at a high rate of speed and needs to stop quickly, often such quick stops cause the skater to fall forward. Most in-line skaters wear protective gear such as helmets, knee and elbow pads and hand pads to cushion these body parts in the event of a fall. Despite the wearing of these types of protective equipment many serious injuries occur. The present invention provides a safer and quicker way of stopping which will eliminate many of the injuries sustained by a forward head long fall Some in-line roller skates use a braking device which attempts to duplicate the hockey stop. One such braking device is disclosed in U.S. Pat. No. 4,618,158. In this patent an in-line skate is disclosed for use by figure skaters. A pair of in-line wheels at the toe and heel area are rotatably secured by carrier yoke supports to a mid-section support depending from a foot plate. The yoke supports are able to rotate in a direction transverse to, and about an axis parallel to, the skaters foot in a toe to heel direction. A braking mechanism is provided which includes a non-round braking surface in an axial extension in a housing rotatably secured to each yoke support. A spring urges a ball bearing against the non-round surface to provide a retarding force to the rotation of the yoke supports as a function of the degree of rotation. Wheel carrier yokes extend from opposite ends of the brake yoke supports. Auxiliary rollers on opposite sides of the main rollers, defining an extension of the surface of the main spherical rollers, are attached to the pair of main spherical rollers.

When the main rollers rotate about a longitudinal front to rear axis in a hockey stop motion, the auxiliary rollers, which are barrel shaped, contact the ground and support the skate. The rotation in this transverse direction activates the braking action to resist the prior forward motion of the skater. This skate is relatively complex, limits the number of wheels that can be used and is relatively costly to fabricate.

A brake and wheel for in-line roller skates is also disclosed in U.S. Pat. No. 5,312,165. This construction uses slip discs on a retainer ring forming the skate wheels. The discs provide a transverse braking skid to provide a friction engagement with the main support structure while the skate moves in the transverse direction.

U.S. Pat. No. 5,246,236 discloses a roller skate wheel for providing rolling action in forward and lateral directions. The main rollers are provided with secondary rollers which rotate about axes transverse to the longitudinal axis of rotation of the main rollers. Metal friction applying brakes contact the secondary rollers. The friction applied to the secondary rollers controls resistance to lateral rolling to provide a braking action.

Other skate and wheel constructions are disclosed in U.S. Pat. Nos. 5,199,727; 5,135,244; 4,838,564; 4,294,456; 3,936,061 and 2,166,767.

In this invention, and in the embodiments disclosed in the prior U.S. application Ser. No. 08/472,382, an in-line roller skate construction is disclosed with a braking mechanism for generating a stopping action so that stops similar to those made with ice skates, such as a hockey stop; can be made. The invention provides for a braking device that is self contained in each wheel and which applies a settable braking load according to the weight and skating ability of a skater.

SUMMARY AND OBJECTS OF THE INVENTION

An in-line roller skate construction according to the present invention has wheels attached to a foot receiving boot. The longitudinal direction, along a vertical plane passing through the toe and heel, defines forward and rearward skating directions. All of the wheels are mounted for normal rotation in the skating directions and at least one wheel, and preferably two, include a structure permitting wheel revolution in at least two orthogonal directions. This function is accomplished by providing a substantially spherical wheel mounted to rotate about an axis transverse to the skating directions and also for rotation about an axis parallel to the skating directions.

In addition, a braking ability is provided. Each wheel which is mounted for rotation about two axes is provided with an internal braking mechanism which progressively retards or arrests wheel rotation about the axis parallel to the skating directions. In a preferred embodiment of the invention this braking action is accomplished by a resiliently biased camming mechanism which exerts a progressively increasing force, tending to retard further rotation of the wheel about the axis parallel to the skating direction, as the wheel progressively rotates. In this way, when a skater desires to stop, using the hockey stop maneuver, the skater turns sharply from a forward or rearward skating direction, and leans so the feet are tilted at an angle to the skating surface. This tilting action causes those wheels which are rotatable in two directions to begin their rotation about the axis parallel to the skating direction. As the tilt angle increases, the retarding force increases resulting in a progressively increasing frictional braking action.

In a preferred embodiment of the invention all of the wheels are of a substantially spherical shape to provide more of a point contact between the wheels and the skating surface to more closely replicate the blade edge contact between the ice skate and the ice.

Ice skates are not provided with a flat lower blade surface. Instead, the ice skate blades have a slight curved shape in the heel and toe area so that the heel and toe area curve upwardly. This blade feature provides an ability to make sharper turns than if the bottom of the blades were completely flat. The preferred embodiment of the present invention replicates this feature of an ice skate blade to provide an inline roller skate with superior turning capabilities over prior in-line skates where all the rollers are mounted so that they are all in contact with the skating surface.

To more closely replicate an ice skating action, at least a pair of center in-line wheels are mounted to extend further from the foot bed than the wheels on the heel and toe area. In normal forward and rearward skating mode, as the skater moves, the tendency is to lean forward so that the foot also pivots forward. The result is that the front three wheels are in contact with the ground. On executing a turn, especially a sharp turn, the skater leans backward so that the foot also pivots back. The result is that the three rear wheels are in contact with the ground. This is the reason that the skate of the present invention provides an increased ability to execute turns. The present invention has recognized that increased stopping capability can be achieved on all types of skating surfaces by using only the interior wheels of the array for stopping purposes. Thus the support system has been designed to permit a rocking action to place only the interior wheels in contact with the ground when stopping. In executing the hockey stop maneuver only the interior wheels contact the ground so it is only necessary to provide a braking mechanism on these wheels.

The spring force exerted by the resiliently biased camming mechanism may be adjusted to accommodate the weight and skating ability of the skater by selecting resilient spring members of a desired spring force. Additionally, the spring force selected must be sufficiently stiff to preclude wheel rotation about the axis parallel to the skating directions when the skater is merely executing a turning maneuver with no intention of stopping. Thus, with a sufficiently stiff spring force less severe turning movement will not permit any wheel rotation other than rotation in the skating directions.

Accordingly, it is an object of the present invention to provide an in-line roller skate with superior quick stopping capability.

It is a further object of the present invention to provide an in-line roller skate with which a skater can stop by executing what is known as a hockey stop.

A still further object of the present invention is to provide an in-line roller skate with wheels that can rotate on an axis parallel to the skating direction as well as on an axis transverse to the skating direction.

Yet a further object of the present invention is to provide an in-line roller skate with wheels that can rotate on two axes, one transverse to the skating directions and one parallel to the skating directions with provision to arrest or retard wheel rotation on the axis parallel to the skating direction when the skater executes a maneuver known as a hockey stop.

A still further object of the present invention is to provide an in-line roller skate which more closely replicates the turning ability of ice skates.

Yet, another object of the present invention is to provide an in-line roller skate which is safer to use and which would be less prone to result in serious injuries due to falls.

These and other objects and advantages of the present invention will be more readily ascertainable with reference to the following specification and drawings.

BRIEF DESCRIPTION OF THE DRAWINGS

FIG. 1 is an elevational view showing a preferred embodiment of the in-line skate of the present invention;

FIG. 2 is a partial elevational view taken along the line 2—2 in FIG. 1;

FIG. 3 is a fragmentary sectional view taken along the line 3—3 of FIG. 1;

FIG. 8 is a cross sectional view of a wheel half with bearing and retaining ring; and FIG. 9 is a partial cross sectional view of the transverse braking wheel axle and mount assembly.

DESCRIPTION OF THE PREFERRED EMBODIMENTS

Figure 4:
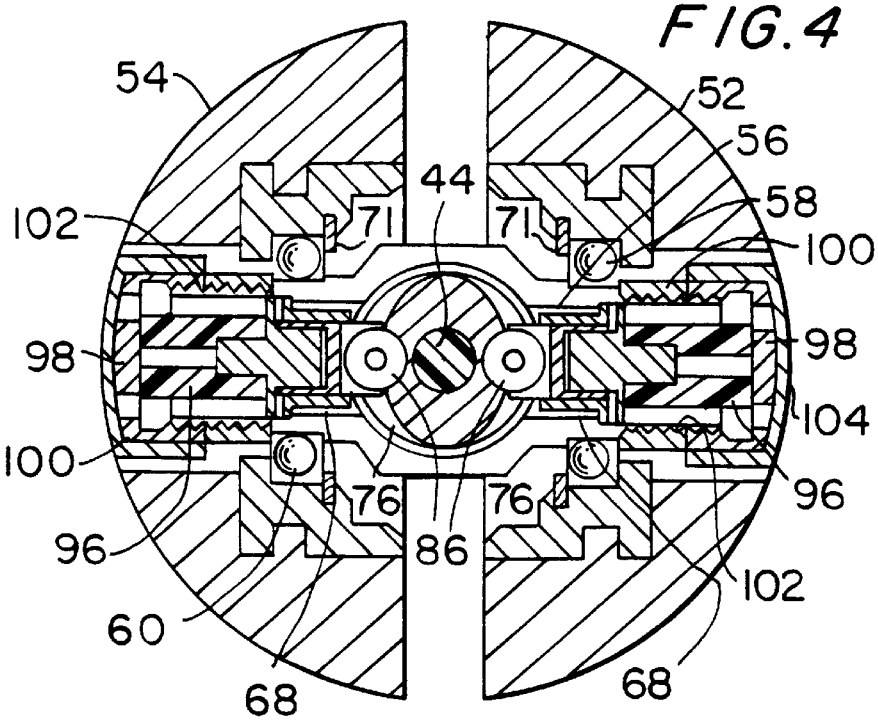
FIG. 4 is an enlarged sectional view of one of the inline wheels provided with the braking mechanism.

As seen initially in FIGS. 1–3, the skate 10 of the present invention includes a conventional shoe boot 12, having a heel area 14 and a toe area 16 to which is secured a sole plate 18.

A toe wheel bracket mount 20 and a heel wheel bracket mount 22 are secured to the sole plate in any convenient manner, for example by rivets, to rotatably support a toe wheel assembly 24 and a heel wheel assembly 26, respectively. As best seen in FIG. 2, each of the toe and heel wheel assemblies are preferably a pair of semispherical members 26 and 28 rotatably mounted on axles 30 and 32 in each wheel support bracket 20 and 22, respectively. Each of the toe wheels 24 and 26, accordingly, are rotatably mounted to rotate on an axle transverse to a vertical plane passing through the heel and toe in the normal forward and rearward skating directions. All of the wheel elements may be constructed of any suitable material such as high impact engineering thermoplastic materials resistant to wear and abrasion. The exterior surfaces may be smooth, which normally provides sufficient friction, grooved or slightly roughened.

Secured to the center area of the sole plate 18 in any convenient manner is a center bracket mount 34 provided with spaced arms 36 and 38 within which is secured a rocker body plate 40, see FIG. 9 as well. Rocker body plate 40 includes a through bore 42 to receive interior wheel support shaft 44. Each end of shaft 44 extends beyond the rocker body to permit mounting of inner wheel assemblies 46, as will be explained more fully hereafter. Wheel support shaft 44 is provided with a pair of under cut areas 48 so as to be securable within the rocker body 40 by set screws 50, as shown in FIG. 9. Rocker body plate 40 is secured within arms 36 and 38 by a bolt 47, nut 49 and bushing 51 so that it may be pivoted about the axis of bolt 47 in use. It is this pivoting feature which allows both the use of three forward or three rear wheels on normal skating operations and only interior wheel contact on stopping maneuvers. In actual use, the interior wheels maintain ground contact but allow the skater's foot to pivot.

While a preferred arrangement has been described where the toe, heel and interior wheel supports are separate, it is evident that a single bracket could also be used for mounting the wheels if so desired.

With reference to FIGS. 4, 5, 6 and 8, each inner wheel assembly 46, similar to toe wheel assemblies 24 and 26 are semispherical elements 52 and 54, respectively, and are spaced apart and rotatably mounted on a wing axle member 56 by suitable bearings 58 and 60, respectively.

Wing axle member 56 is disposed between a pair of substantially cylindrical spaced body portions 62 having a through bore 64 therethrough to receive wheel support shaft 44. Set screws 66 through body portions 62 secure the body portions to shaft 44. Additionally cylindrically shaped laterally extending wing axle elements 68 are rotatably mounted about shaft 44 in any convenient manner, for example, by a pair of bushings 69. Wing axle element 68 is positioned between body portions 62 so as to fix the location about shaft 44. The exterior surface of each wing element 68 includes shoulders 70 which provide one seat for bearings 58. The other bearing seat is provided by a bearing ring 71 within wheel elements 52 and 54. The inner wheel assemblies 46 thus rotate in the skating directions about bearings 58.

Figure 5:
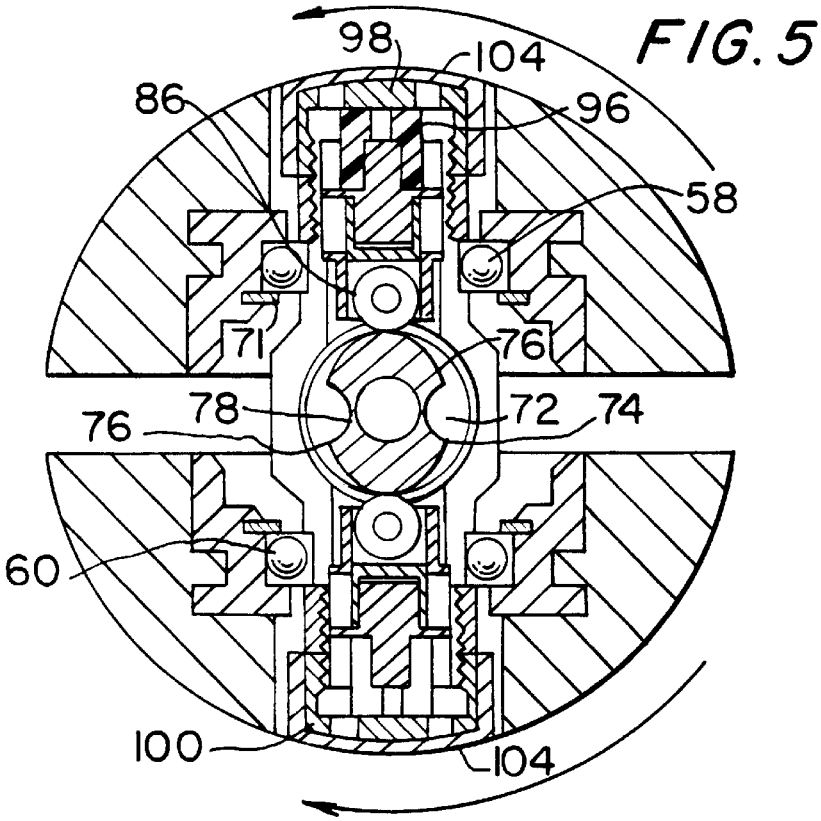
FIG. 5 is a view similar to FIG. 4, showing the wheel rotated 90°.
Figure 7:
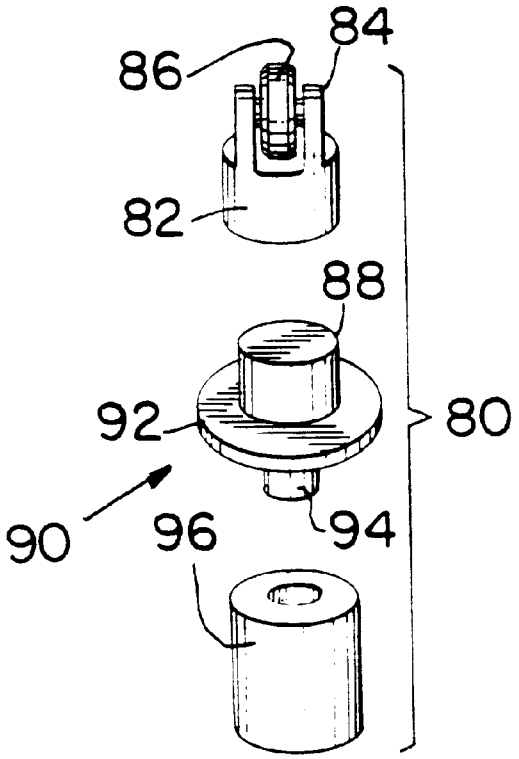
FIG. 7 is an exploded perspective view of the cam follower assembly.

As best seen in FIGS. 4 and 5, cylindrical body portion 68 of wing axle member 56 includes a cylindrical bore 69 spaced outwardly from wheel support shaft 44 to define a space 72 therein. Within this space 72 a substantially elliptical cam member 74 is secured to shaft 44 so that it will not rotate about shaft 44. The exterior cam surfaces 76, as best seen in FIG. 5, include, on each side, circular indented segments 78. A pair of cam follower assemblies 80 are provided within each wing axle 68 on each side of cam member 74. Cam follower assemblies 80 include a cam follower wheel support member 82 having extending lugs 84 on which is rotatably mounted a cam follower wheel member 86, see FIG. 7. The cam follower wheel support member 82 includes a cylindrical body portion within which is received a cylindrical segment 88 of a spring pad 90. Spring pad 90 further includes an extending flange 92 to provide a spring end rest and a smaller cylindrical segment 94 upon which is received a cylindrical resilient spring member 96.

In a preferred embodiment, the resilient spring members 96 are short cylindrical segments of an engineering thermoplastic material such as polyurethane which is compressible upon the application of a force thereto. Alternatively, the resilient spring member can be a conventional coiled spring of steel or other metallic or non-metallic material. The relative compressibility of the spring element 96 is selected depending upon the amount of compressing force desired which in turn is dependent upon the weight and skating ability of the skater using the skates of this invention. Because the spring elements are replaceable, as will be explained more fully below, it is relatively easy to replace spring elements 96 of different compressibility factors to select the degree of compressibility or spring factor most appropriate for the individual skater.

Figure 6:
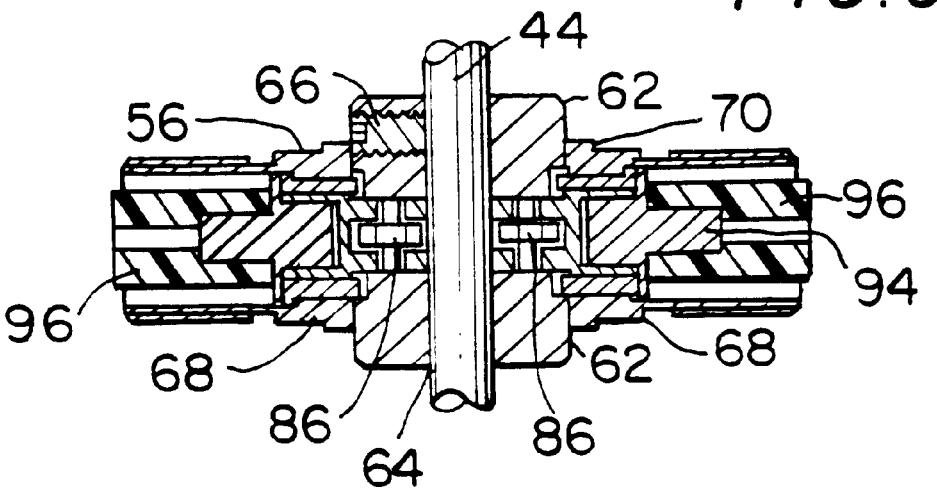
FIG. 6 is an enlarged cross section of the axle assembly of a braking wheel.

As best seen in FIGS. 4, 5, and 6 the cam follower assemblies are disposed within the substantially cylindrical opening within wing axle elements 68. Each cam follower assembly 80 is held in place by a spring cap 98 threaded as at 100 into a bushing 102 fixed within wing element 68. An end cap 104 contoured to fit flush within the semispherical wheel assembly 46 is also provided. The end caps 104 and spring caps 98 are removable to permit changing of the resilient elements 96 as desired or needed. It is also apparent that the spring stiffness of resilient members 96 may also be adjusted by the degree with which spring cap 98 is threaded into bushing 102. Maximum threading will increase the spring force while backing off the spring cap will lessen the spring force.

In normal skating a skater will make turning maneuvers without intending to stop. Those normal turning maneuvers will not create as high a lateral force component on the wheels as would be exerted when the skater executes a sharp turn as would be executed for a hockey stop maneuver. Accordingly, the spring stiffness for the resilient members 96 must be sufficiently high to maintain the cam follower wheel members 86 within the cam indented segments 78. This will insure that the interior wheel members will continue to rotate in only the skating directions and not rotate about the longitudinal axis parallel to shaft 44.

FIG. 4 illustrates the at rest normal position of wheel assembly 46 when it is positioned for forward or rearward skating or for turning maneuvers where there is no intent to stop along the normal skating directions. In this position, the cam follower rollers 86 are seated in the indented circular segments 78 in cam member 74 under the urging of the resilient members 96. When a skater executes a transverse turn to initiate a hockey stop action, wheel assemblies 46 rotate in one of the directions indicated by the arrows in FIG. 5, depending on the direction of turn, forcing the cam follower rollers 86 to ride out of the recesses 78 and over the cam surfaces 76. As the cam followers 86 ride the cam surfaces 76 with progressively increasing rotation of the wheel element 46, a progressively increasing force is exerted by the resilient elements 96. This progressively increasing force provides a progressively increasing braking force to retard or arrest further rotation of the wheel element 46. In this manner, a progressively increasing braking action is provided to permit the skater to execute a stopping action.

It is also apparent that the semispherical wheel surfaces are also beneficial in providing the increased ability to execute sharp turns. The spherical-like surface provides multiple uniform tangent points between the wheel surface and the ground. Thus no matter how steep or severe an angle the skater's body and feet form with the ground, the wheel contact angle remains uniformly constant.

It is thus seen that the present invention provides a roller skate which has the ability to more closely replicate an ice skate both as to an increased ability to navigate sharper turns and also to allow for a rapid and safer stopping maneuver. While the invention has been described with respect to roller skates of the in-line type it is equally applicable to the more traditional tandem wheel skates as well.

It will also be apparent to one of ordinary skill in the art that there are various ways to rotatably mount wheels, which may also be non spherical in shape, so as to be rotatable along two perpendicular axes. One of ordinary skill in the art may also envisage other types of braking mechanisms to retard or arrest further rotation.

The disclosed embodiments are provided by way of illustration and not limitation as further modifications may be made without departing from the spirit and scope of the present invention as defined in the following claims.

What is claimed is:

1. A roller skate having a plurality of wheels in linear array attached to a foot receiving boot having a toe area and heel area with a plane passing through the toe area and heel area defining forward and rearward skating directions comprising:

a wheel depending from said toe area;

a wheel depending from said heel area;

a pair of axles positioned transverse to said skating directions on a support member depending from said boot;

at least two interior wheel assemblies rotatably mounted on said axles for rotation in said skating directions;

each said axle being positioned within said interior wheel assemblies; and said axle being rotatably mounted with respect to said support member so that each said interior wheel assembly is rotatable about an axis parallel to said skating directions.

2. The roller skate according to claim 1 including a brake member for each of said interior wheel assemblies in operative association with each said axle to retard rotation of said wheel assembly as each said wheel assembly rotates about said axis.

3. The roller skate according to claim 2 wherein each said brake member provides a progressively increasing braking force as each said wheel assembly progressively increases its degree of rotation about said axis.

4. The roller skate according to claim 3 wherein each said brake member comprises a cam surface and a cam follower urged into contact with said cam surface by a resilient member.

5. The roller skate according to claim 4 wherein each said cam surface is mounted on said support member and each said cam surface is shaped to progressively move said cam follower outwardly against said resilient member thereby progressively compressing said resilient member to progressively increase the braking force.

6. The roller skate according to claims 1, 2, 3, 4 or 5 wherein said wheels depending from said toe and heel areas are elevated relative to said at least two interior wheel assemblies.

7. The roller skate according to claims 1, 2, 3, 4 or 5 wherein said wheels depending from said toe and heel areas are elevated relative to said at least two interior wheel assemblies and wherein said at least two interior wheel assemblies are pivotally mounted.

8. The roller skate according to claims 1, 2, 3, 4 or 5 wherein said wheels are substantially spherical in shape.

9. The roller skate according to claim 1 including a brake member in operative association with each said axle to retard rotation of each said interior wheel assembly as each said wheel assembly rotates about said axis.

10. The roller skate according to claim 9 wherein each said brake member provides a progressively increasing braking force as each said wheel assembly progressively increases its degree of rotation about said axis.

11. The roller skate according to claim 10 wherein each said brake member comprises a cam surface and a cam follower urged into contact with said cam surface by a resilient member.

12. The roller skate according to claim 11 wherein said cam surface is mounted on said support member and said cam surface is shaped to progressively move said cam follower outwardly against said resilient member thereby progressively compressing said resilient member to progressively increase the braking force.

13. A roller skate having wheels attached to a foot receiving boot having a toe area and heel area with a plane passing vertically through the toe and heel areas defining forward and rearward skating directions, said wheels being mounted for normally rotating in said skating directions, said roller skate comprising:

a wheel depending from said toe area;

a wheel depending from said heel area;

a support member depending from said boot;

at least a pair of interior wheels each comprising at least one segment and having at least one surface substantially defining a surface of revolution in at least two orthogonal directions; and an axle within each of said interior wheels having an axis extending transverse to said skating directions and rotatably secured to said support member for rotation in a first angular direction in a plane transverse to the skating directions.

14. The roller skate according to claim 13 wherein said support comprises a shaft having an axis extending in said skating directions and first bearing means for rotatably securing each said axle for rotation in said first angular direction about said shaft.

15. The roller skate according to claim 13 including brake means for impeding the rotation of each said axle in said first angular direction to provide a brake load in said first angular direction.

16. The roller skate according to claim 15 wherein said brake means comprises means for providing a progressively increasing braking resistance to said axle as said axle rotates from a neutral position.

17. The roller skate according to claim 16 wherein said brake means includes a cam secured to said support and resilient means secured to said axle for engaging said cam and responsive to the rotation of said axle in said first angular direction for providing said braking resistance.

18. The roller skate according to claim 13 wherein said wheels each comprise two substantially semispherical segments forming a substantially spherical wheel, each segment being rotatably secured for rotation in said skating directions independently of the other segments on a different axle.

19. The roller skate according to claim 18 wherein said axles are pivotally mounted to permit said axles to pivot with respect to said boot.

* * * * *